US011512892B2

(12) United States Patent
Guo et al.

(10) Patent No.: US 11,512,892 B2
(45) Date of Patent: Nov. 29, 2022

(54) REFRIGERATOR

(71) Applicant: BSH Hausgeraete GmbH, Munich (DE)

(72) Inventors: Xiangfan Guo, Nanjing (CN); Zhihui Zhou, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/109,335

(22) Filed: Dec. 2, 2020

(65) Prior Publication Data

US 2021/0172673 A1 Jun. 10, 2021

(30) Foreign Application Priority Data

Dec. 4, 2019 (CN) ..... 201911225164.3

(51) Int. Cl.
*F25D 23/06* (2006.01)

(52) U.S. Cl.
CPC ..... *F25D 23/065* (2013.01); *F25D 23/069* (2013.01); *F25D 2201/126* (2013.01); *F25D 2400/04* (2013.01)

(58) Field of Classification Search
CPC .... F25D 23/065; F25D 23/067; F25D 23/069; F25D 23/085; F25D 2201/126; F25D 2323/06; F25D 2400/04; F25D 2400/06
See application file for complete search history.

(56) References Cited

U.S. PATENT DOCUMENTS 3,632,011 A * 1/1972 Kitson ..... F25D 23/064 220/592.06
4,558,503 A * 12/1985 Wilson ..... B23P 15/26 29/446
4,914,341 A * 4/1990 Weaver ..... F25D 23/062 312/407
9,429,357 B2 * 8/2016 Cha ..... B23P 15/26
2011/0023529 A1 * 2/2011 Kim ..... F25D 23/021 62/441

FOREIGN PATENT DOCUMENTS

| | | | | |
|---|---|---|---|---|
| CN | 108917278 A | | 11/2018 | |
| JP | H-11304353 A | * | 11/1999 | F25D 23/065 |
| KR | 1020070041842 A | * | 4/2007 | |
| KR | 1020090133019 A | * | 12/2009 | |
| WO | WO-2013084582 A1 | * | 6/2013 | F25D 23/062 |
| WO | WO-2015131771 A1 | * | 9/2015 | F25D 23/065 |
| WO | WO-2017144243 A1 | * | 8/2017 | F25D 23/085 |
| WO | WO-2018024479 A1 | * | 2/2018 | F25D 23/00 |

* cited by examiner

*Primary Examiner* — Andrew M Roersma

(74) *Attorney, Agent, or Firm* — Laurence A. Greenberg; Werner H. Stemer; Ralph E. Locher

(57) ABSTRACT

A refrigerator includes a cabinet having an inner casing, an outer casing, and a thermal insulation space located between the inner casing and the outer casing and filled with a thermal insulation material, to form a pair of thermal insulation walls disposed opposite to each other. The thermal insulation walls have recesses formed in the inner casing and opened forward. A beam bridges the pair of thermal insulation walls, the beam including insert portions disposed on two ends and respectively inserted into the corresponding recesses. A first fixing mechanism is at least partially located in the recess and fixes the insert portion to the thermal insulation wall, which not only facilitates the assembly of the beam and improves production efficiency, but also is beneficial to improving a weight capacity of the beam.

12 Claims, 5 Drawing Sheets

REFRIGERATOR

CROSS-REFERENCE TO RELATED APPLICATION

This application claims the priority, under 35 U.S.C. § 119, of Chinese application CN 201911225164.3, filed Dec. 4, 2019; the prior application is herewith incorporated by reference in its entirety.

BACKGROUND OF THE INVENTION

Field of the Invention

Published, Chinese patent application CN108917278A discloses a cross beam assembly with an adjustable hinge and a refrigerator, including a cross beam extending laterally. The hinge is connected to one side of the cross beam by a fastener, where the cross beam assembly further includes a reinforcing member and an operation member, and the reinforcing member is disposed on the other side of the cross beam. A slotted hole is laterally provided in the cross beam. The fastener passes through the slotted hole and is fixed to the reinforcing member. The operation member operably rotates to drive the reinforcing member to have lateral displacement relative to the cross beam.

BRIEF SUMMARY OF THE INVENTION

An objective of the embodiments of the present invention is to provide an improved refrigerator and a beam for a refrigerator.

Another objective of the embodiments of the present invention is to provide a refrigerator and a beam for a refrigerator that help improve user experience.

An aspect of the embodiments of the present invention relates to a refrigerator, including: a cabinet, the cabinet including an inner casing, an outer casing, and a thermal insulation space located between the inner casing and the outer casing and filled with a thermal insulation material, to form a pair of thermal insulation walls disposed opposite to each other. The thermal insulation walls include recesses formed in the inner casing and opened forward. A beam bridges the pair of thermal insulation walls, the beam has insert portions disposed on two ends and is respectively inserted into the corresponding recesses. The refrigerator further includes a first fixing mechanism, the first fixing mechanism being at least partially located in the recess and fixing the insert portion to the thermal insulation wall.

In this structure, the recesses that are opened forward are provided in the thermal insulation wall, to facilitate insertion of the insert portions of the beam and positioning the beam in the recesses. The insert portions are fixed to the recesses by a first fixing structure, so that the beam is fixed to the thermal insulation wall, which not only facilitates assembly of the beam and improves production efficiency, but also is beneficial to improving a weight capacity of the beam.

In addition, the structure allows that the beam can bear relatively large pressure to be expected. For example, the structure makes it possible to mount a relatively heavy door on the beam. When the relatively heavy door is mounted on the beam, a possibility that the beam turns over and causes the door to sink and deform can be reduced.

According to an exemplary implementation of the present invention, a second fixing mechanism is further included. The second fixing mechanism is located outside the recess and fixes the beam to the outer casing. Therefore, the beam is fixedly connected to the outer casing by using the second fixing mechanism. In this case, the beam may not only be connected to the inner casing, but also be connected to the outer casing, which is beneficial to assembling the beam firmly and reliably.

According to an exemplary implementation of the present invention, the first fixing mechanism and the second fixing mechanism are distanced from each other along a depth direction of the inner casing and/or along a length direction of the beam. Therefore, the beam can be fixed at two different points, enabling the beam to be fixed more firmly and reliably.

According to an exemplary implementation of the present invention, the first fixing mechanism is configured to fix a rear portion of the insert portion to the thermal insulation wall. Therefore, not only the insert portion can be fixed to the rear wall, but also the first fixing mechanism can be prevented from being exposed to consumers, thereby improving beauty of the refrigerator.

According to an exemplary implementation of the present invention, the recess has a rear wall facing the opening. The insert portion is fixed to the rear wall by the first fixing mechanism. Therefore, the insert portion is fixed to the rear wall, which facilitates the fixing of the beam.

According to an exemplary implementation of the present invention, the first fixing mechanism includes a fastener. The inner casing includes a through hole in communication with the recess, and the fastener passes through the through hole and is connected to the insert portion. Therefore, the insert portion and the recess are connected together by the fastener, enabling the insert portion to be connected to the recess more firmly and reliably.

According to an exemplary implementation of the present invention, the fastener passes through the first through hole from a side of the inner casing, which side faces the thermal insulation space, and is connected to the insert portion.

According to an exemplary implementation of the present invention, the first fixing mechanism includes a first reinforcing member attached to a side of the inner casing, which side faces the thermal insulation material and a fastener fixing the insert portion to the first reinforcing member. Therefore, the first reinforcing member may be located in a foaming thermal insulation layer. During foaming, the first reinforcing member may be firmly fixed to the foaming thermal insulation layer, which is beneficial to improving strength of the first reinforcing member. In this case, the thermal insulation material, together with the beam, bears a weight, thereby further improving the weight capacity of the beam.

According to an exemplary implementation of the present invention, the first reinforcing member includes a first reinforcing portion attached to the rear wall and a second reinforcing portion coupled to the first reinforcing portion and bent backward.

According to an exemplary implementation of the present invention, the second reinforcing portion extends along the inner casing and is distanced from the inner casing, and the thermal insulation material is disposed between the inner casing and the second reinforcing portion. Therefore, the second reinforcing portion may be coated by the thermal insulation material, which is beneficial to improving the strength of the second reinforcing portion, thereby further improving the weight capacity of the beam.

According to an exemplary implementation of the present invention, the first reinforcing member is provided with at least one second through hole, and the through hole is configured to allow the thermal insulation material to pass through. Therefore, the thermal insulation material passes through the second through hole, enabling a periphery of the first reinforcing member to be surrounded by the thermal insulation material, which is beneficial to improving the strength of the first reinforcing member.

According to an exemplary implementation of the present invention, the beam includes a housing and a thermal insulation material located in the housing. The first fixing mechanism includes a second reinforcing member located in the insert portion, and the second reinforcing member is bonded to the beam thermal insulation material. Therefore, the second reinforcing member and the thermal insulation material located in the housing are bonded together, which is beneficial to the fixing of the second reinforcing member, and improving strength of the second reinforcing member, and the beam thermal insulation material, together with the beam, bears a weight, thereby improving the weight capacity of the beam.

According to an exemplary implementation of the present invention, the second reinforcing member is disposed along a rear wall of the housing, which is beneficial to the mounting of the second reinforcing member, thereby improving the production efficiency.

Another aspect of embodiments of the present invention relates to a beam for a refrigerator, including a housing defining an accommodating cavity and a thermal insulation material located in the accommodating cavity, where two ends of the beam respectively include a first fixing portion and a second fixing portion that are distributed in a spaced apart manner in a front-back direction and that are configured to be coupled to the refrigerator. Therefore, the beam may be fixed by the first fixing portion and the second fixing portion to the refrigerator at two different points of the beam, which is beneficial to improving mounting stability and firmness of the beam.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

For a further understanding of the objectives, structures, features and functions of the present invention, a detailed description is made below in cooperation with embodiments.

Figure 1:
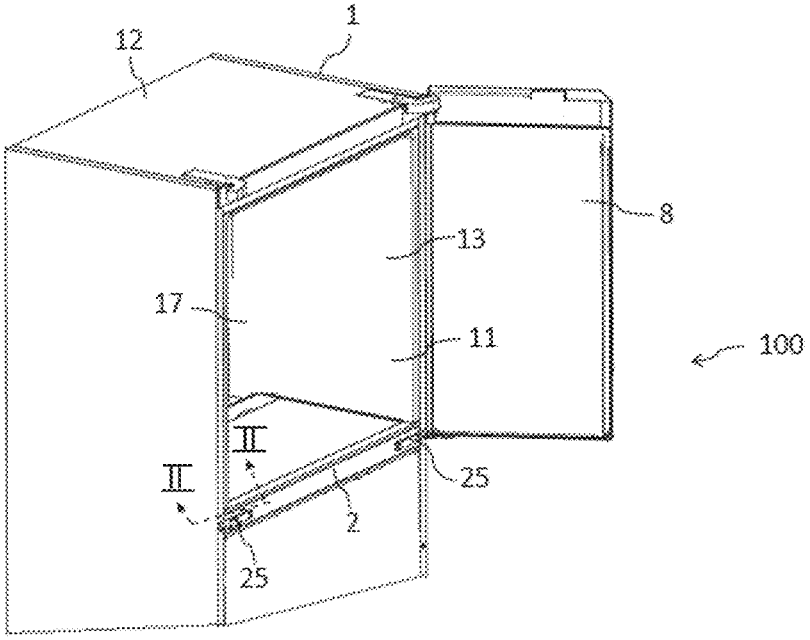
FIG. 1 is a diagrammatic, partial, three-dimensional view of a refrigerator according to an exemplary embodiment of the present invention.
Figure 2:
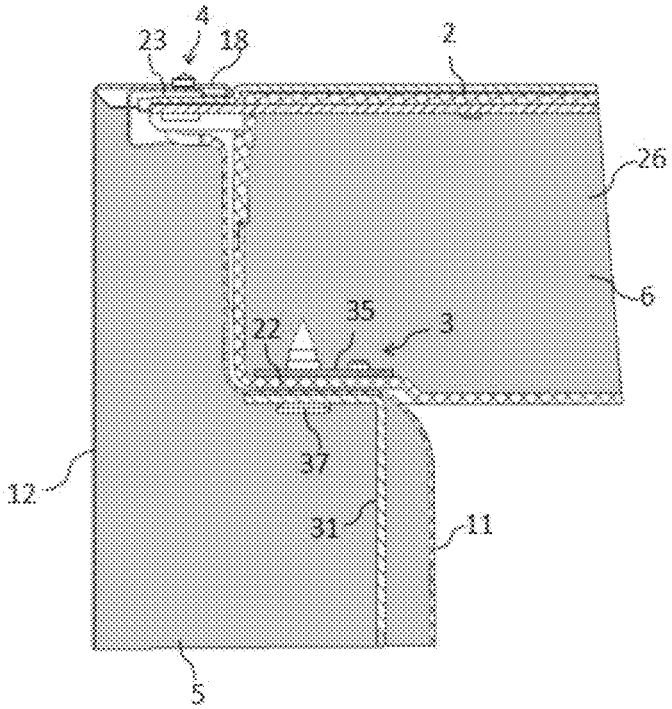
FIG. 2 is a schematic partial cross-sectional view of FIG. 1 taken along the line II-II.

Referring now to the figures of the drawings in detail and first, particularly to FIGS. 1 and 2 thereof, there is shown a refrigerator 100 that has a cabinet 1 with a storage compartment 7. The cabinet 1 includes an inner casing 11, an outer casing 12, and a thermal insulation space located between the inner casing 11 and the outer casing 12 and filled with a thermal insulation material 5, to form a pair of thermal insulation walls 13 disposed opposite to each other.

The thermal insulation walls 13 include recesses 14 formed in the inner casing 11 and opened forward. The inner casing 11 has a pair of opposite side walls, and a top wall and a bottom wall connected to the side walls.

The storage compartment 7 has an opening 17 opened forward, and a recess 14 is opened facing the opening 17. The recess 14 is provided in the side wall close to the opening 17.

The refrigerator 100 further includes a beam 2 bridging the pair of thermal insulation walls 13. A front surface of the beam 2 and a front panel of the cabinet 1 are roughly in the same plane.

Figure 3:
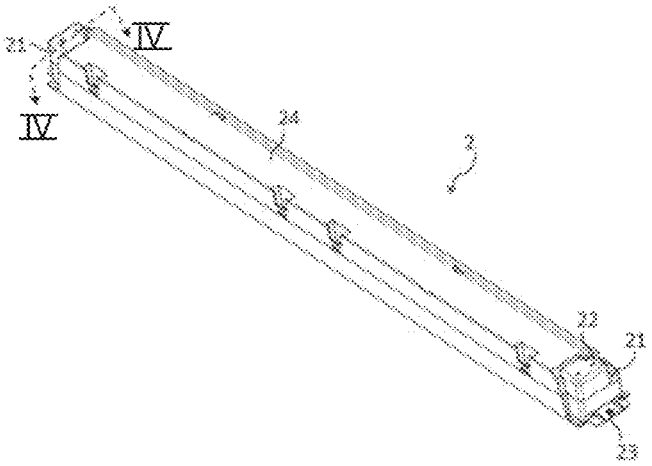
FIG. 3 is a schematic three-dimensional view of a beam according to an embodiment of the present invention.

As shown in FIG. 3, the beam 2 includes insert portions 21 disposed on two ends and respectively inserted into the corresponding recesses 14 and a body portion 24 connecting the two insert portions 21. Each of the insert portions 21 is disposed in a corresponding end of the beam 2. A length of the body portion 24 is roughly equal to a transverse width of the storage compartment 7 on a front end.

A shape of the recess 14 matches a shape of the insert portion 21.

As shown in FIG. 1, the refrigerator 100 further includes a door 8 for opening or closing the opening 17. The door is hingedly connected to a front side of the cabinet 1. In this embodiment, the refrigerator 100 further includes a hinge 25 fixed on the beam 2. The door 8 is connected to the hinge 25. Therefore, the beam 2 bears a partial weight of the door 8.

Figure 4:
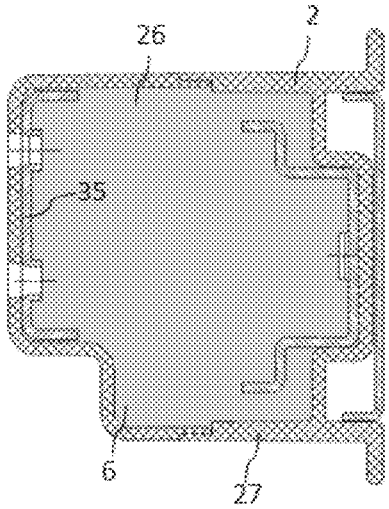
FIG. 4 is a schematic partial cross-sectional view of FIG. 1 taken along the line IV-IV.
Figure 5:
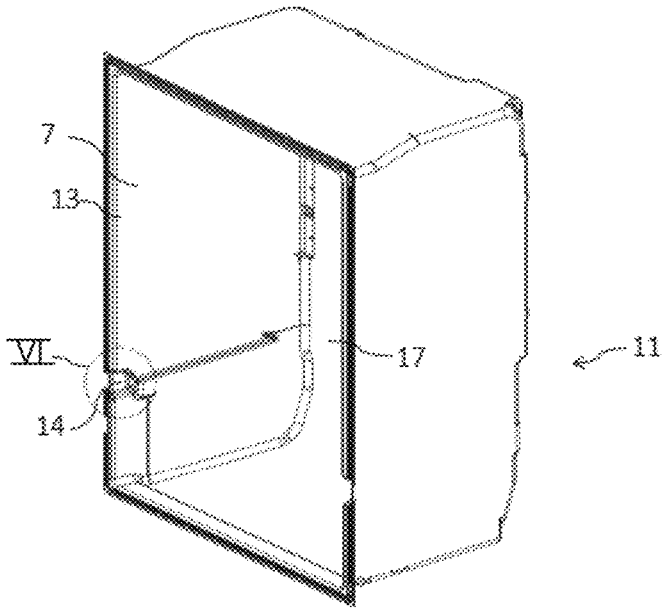
FIG. 5 is a schematic partial three-dimensional view of an inner casing of a refrigerator according to an exemplary embodiment of the present invention.

As shown in FIG. 4, the beam 2 includes an accommodating cavity 26, a housing 27 defining the accommodating cavity 26, and a beam thermal insulation material 6 located in the accommodating cavity 26. In this embodiment, the beam thermal insulation material 6 is formed by injecting a foaming agent into the accommodating cavity. In an alternative implementation, a pre-foamed thermal insulation part may be filled into the accommodating cavity.

As shown in FIG. 3, two ends of the beam 2 respectively include a first fixing portion 22 and a second fixing portion 23 that are distributed in a spaced apart manner in a front-back direction and that are configured to be coupled to the refrigerator 100. The beam 2 is mounted at different positions of the cabinet 1 by the first fixing portion 22 and the second fixing portion 23. In an embodiment, as shown in FIG. 2, the first fixing portion 22 is connected to the inner casing 11, and the second fixing portion 23 is connected to the outer casing 12. Therefore, the beam 2 is respectively fixed to the inner casing 11 and the outer casing 12, so that the beam 2 may be connected to the cabinet 1, thereby reducing a possibility that the beam 2 turns over when bearing a weight of the door 8.

The refrigerator 100 further includes a first fixing mechanism 3, and the beam 2 is fixed into the inner casing 11 by a first fixing structure. The first fixing mechanism 3 is at least partially located in the recess 14 and fixes the insert portion 21 to the thermal insulation wall 13.

The insert portion 21 is connected to one of the walls in which the recesses 14 are formed.

Figure 6:
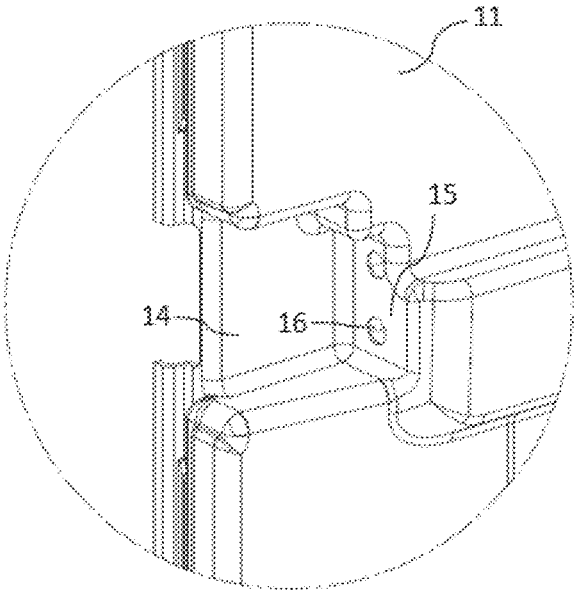
FIG. 6 is an enlarged three-dimensional view of location VI shown in FIG. 4.

The first fixing mechanism 3 is configured to fix a rear portion of the insert portion 21 to the thermal insulation wall 13. Specifically, as shown in FIG. 2 and FIG. 6, the recess 14 has a rear wall 15 facing the opening 17. The rear portion of the insert portion 21 is face-to-face with the rear wall 15. The insert portion 21 is fixed to the rear wall 15 by the first fixing mechanism 3.

As shown in FIG. 6, the inner casing 11 includes a first through hole 16 in communication with the recess 14. In an embodiment, the first through hole 16 is provided in the rear wall 15.

As shown in FIG. 2, the first fixing mechanism 3 includes a fastener 37. The fastener 37 passes through the first through hole 16 and is connected to the insert portion 21, so that the insert portion 21 is fixed to the rear wall 15. In this embodiment, the fastener 37 passes through the first through hole 16 from a side of the inner casing 11, which side faces the thermal insulation space, and is connected to the insert portion 21.

In an embodiment, the fastener 37 includes a screw, in particular the fastener is embodied as a screw. The screw passes through the first through hole 16 to fix the insert portion 21 to the rear wall 15.

The first fixing mechanism 3 further includes a first reinforcing member 31 connected to the inner casing 11 and facing a side of the thermal insulation material 5. The first reinforcing member 31 is located in the thermal insulation space. When the refrigerator 100 is foaming, the first reinforcing member 31 is coated by the thermal insulation material 5, thereby improving strength of the first reinforcing member 31, and further improving the mounting stability and strength of the beam 2, and improving a weight capacity of the beam 2.

Figure 7:
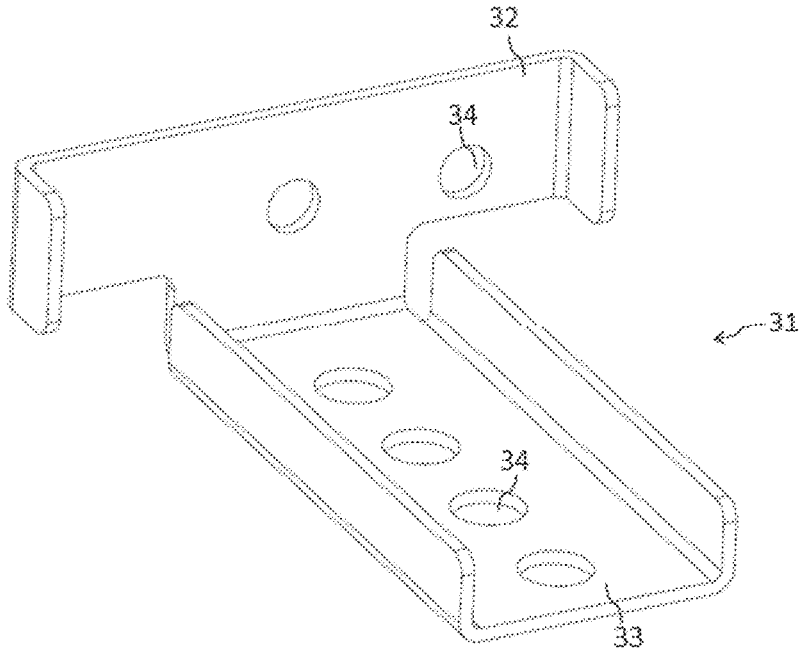
FIG. 7 is a schematic three-dimensional view of a first reinforcing member.

As shown in FIG. 7, the first reinforcing member 31 includes a first reinforcing portion 32 attached to the rear wall 15 and a second reinforcing portion 33 coupled to the first reinforcing portion 32 and bent backward. In an embodiment, the first reinforcing member 31 is an L shape and the first reinforcing portion 32 is perpendicular to the second reinforcing portion 33.

Figure 9:
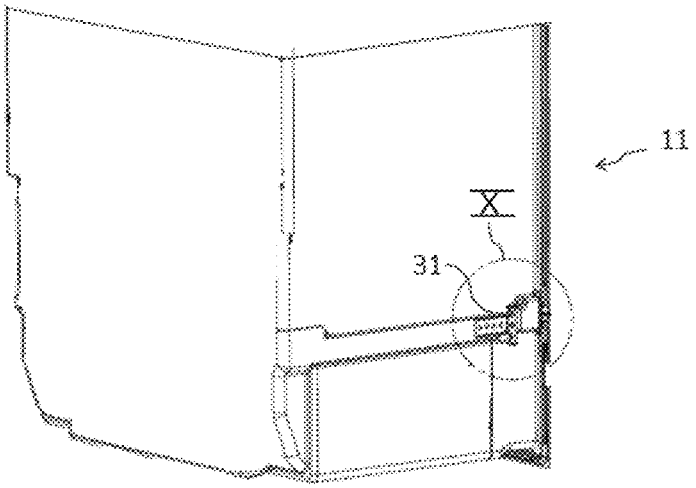
FIG. 9 is a schematic partial three-dimensional view of an inner casing of a refrigerator according to an exemplary embodiment of the present invention from another perspective.
Figure 10:
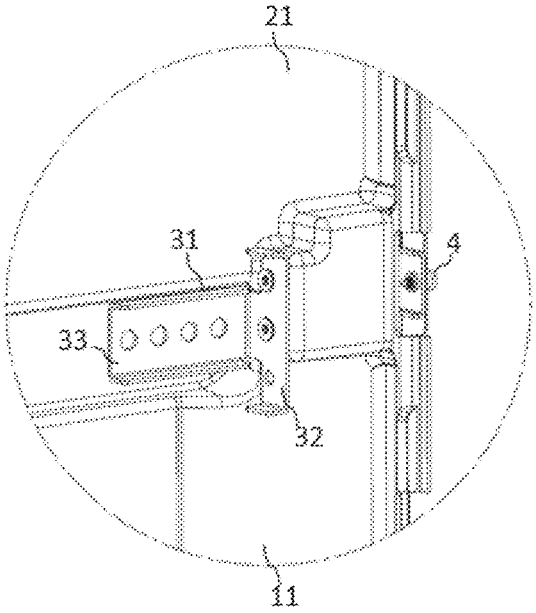
FIG. 10 is an enlarged three-dimensional diagram of location X shown in FIG. 9.

As shown in FIG. 9 and FIG. 10, the first reinforcing portion 32 extends along the rear wall 15. The second reinforcing portion 33 extends along the inner casing 11 and is distanced from the inner casing 11. The thermal insulation material 5 is disposed between the inner casing 11 and the second reinforcing portion 33, which is beneficial to improving the strength of the first reinforcing member 31.

As shown in FIG. 7, the first reinforcing member 31 is provided with at least one second through hole 34, and the second through hole 34 is configured to allow the thermal insulation material 5 to pass through. Specifically, the first reinforcing portion 32 and/or the second reinforcing portion 33 are/is provided with at least one second through hole 34.

In an embodiment, as shown in FIG. 7, the second reinforcing portion 33 is provided with a plurality of second through holes 34, and the first reinforcing portion 32 is also provided with at least one second through hole 34. During foaming, the thermal insulation material 5 may pass through the second through hole 34. The spacing between the second reinforcing portion 33 and the inner casing 11 is filled up with the thermal insulation material 5, and the second through hole 34 is also filled up with the thermal insulation material 5.

In this case, a capacity of grabbing a foaming material of the first reinforcing member 31 can be improved, so that the first reinforcing portion 32 and the second reinforcing portion 33 may grab more foaming material in a foaming process, thereby further improving the strength of the first reinforcing member 31, improving the weight capacity of the beam 2, and reducing the possibility that the beam turns over when bearing the weight of the door 8.

As shown in FIG. 2, the first fixing mechanism 3 further includes a second reinforcing member 35 corresponding to the first reinforcing member 31. The second reinforcing member 35 is disposed in the insert portion 21 and is bonded to the thermal insulation material 5 of the beam 2.

Figure 8:
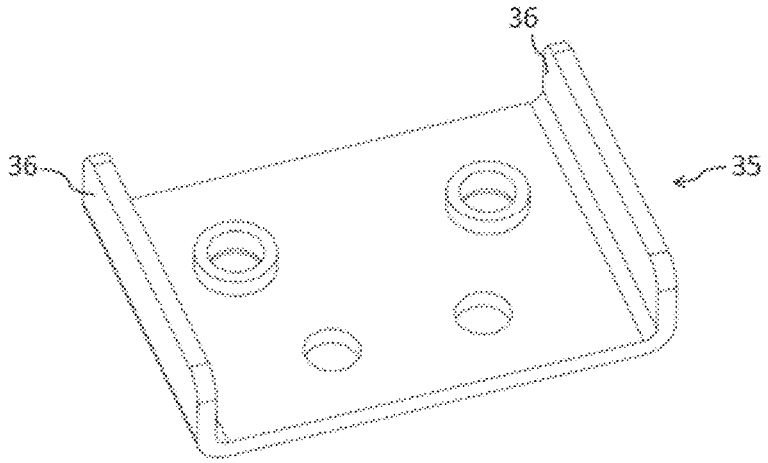
FIG. 8 is a schematic three-dimensional view of a second reinforcing member.

Specifically, the second reinforcing member 35 is disposed in the accommodating cavity 26. The beam thermal insulation material 6 is provided in the accommodating cavity 26. The second reinforcing member 35 is bonded to the beam thermal insulation material 6 in the foaming process. As shown in FIG. 8, the second reinforcing member 35 includes a first flange 36 formed by bending, enabling the second reinforcing member 35 to grab more foaming liquid in the foaming process, thereby improving strength of the second reinforcing member 35.

As shown in FIG. 2 and FIG. 4, the second reinforcing member 35 is disposed along a wall of the housing 27 and corresponds to the first reinforcing member 31. A body portion of the second reinforcing member 35 is disposed along a rear wall of the housing, and the first flange 36 of the second reinforcing member is provided along a side wall of the housing, which is beneficial to improving the strength of the second reinforcing member 35.

The first reinforcing member 31 and the second reinforcing member 35 are respectively provided with through holes through which the fastener 37 passes and that correspond to the first through hole 16. The fastener 37 passes through the first reinforcing member 31, the first through hole 16, and the second reinforcing member 35, to fix the first fixing portion of the insert portion 21 to the rear wall 15 of the recess 14.

The refrigerator 100 further includes a second fixing mechanism 4. The second fixing mechanism 4 is located outside the recess 14 and fixes the beam 2 to the outer casing 12. Specifically, the outer casing 12 has a second flange 18 formed by bending toward the storage compartment 7. The second fixing portion 23 is fixed to the second flange 18 by the second fixing mechanism 4.

As shown in FIG. 2, the first fixing mechanism 3 and the second fixing mechanism 4 are distanced from each other along a depth direction of the inner casing 11 and/or along a length direction of the beam 2. Therefore, the beam 2 is firmly mounted to the cabinet 1, thereby improving the stability of the beam 2.

Various embodiments illustrated with reference to FIG. 1 to FIG. 10 may be combined with each other in any given manner to realize the advantage of the present invention. In addition, the present invention is not limited to the shown embodiments. Usually, apart from the shown means, other means can also be used as long as the means can also achieve the same effect.

REFERENCE NUMERALS

100 Refrigerator
1 Cabinet
2 Beam
3 First fixing mechanism
4 Second fixing mechanism
5 Thermal insulation material
6 beam thermal insulation material
7 Storage compartment
8 Door
11 Inner casing
12 Outer casing
13 Thermal insulation wall
14 Recess
15 Rear wall
16 First through hole
17 Opening
18 Second flange
21 Insert portion
22 First fixing portion
23 Second fixing portion
24 Body portion
25 Hinge
26 Accommodating cavity
27 Housing
31 First reinforcing member
32 First reinforcing portion
33 Second reinforcing portion
34 Second through hole
35 Second reinforcing member
36 First flange
37 Fastener

The invention claimed is:

1. A refrigerator, comprising:

a cabinet having an inner casing, an outer casing, and a thermal insulation space disposed between said inner casing and said outer casing and filled with a thermal insulation material, to form a pair of thermal insulation walls disposed opposite to each other;

said thermal insulation walls having recesses formed in said inner casing and opened forward;

a beam bridging said pair of thermal insulation walls, said beam having insert portions disposed on two ends and respectively inserted into corresponding ones of said recesses;

a first fixing mechanism being at least partially disposed in one of said recesses and fixing one of said insert portions to said inner casing of one of said thermal insulation walls; and a second fixing mechanism disposed outside said recesses and fixing said beam to said outer casing.

2. The refrigerator according to claim 1, wherein said first fixing mechanism and said second fixing mechanism are distanced from each other along a depth direction of said inner casing and/or along a length direction of said beam.

3. The refrigerator according to claim 1, wherein said first fixing mechanism is configured to fix a rear portion of one of said insert portions to one of said thermal insulation walls.

4. The refrigerator according to claim 1, wherein:

said inner casing has a rear wall; and said cabinet has an opening formed therein, wherein said recesses are defined by said rear wall facing said opening, and one of said insert portions is fixed to said rear wall by said first fixing mechanism.

5. The refrigerator according to claim 1, wherein:

said first fixing mechanism has a fastener; and said inner casing has a first through hole formed therein and in communication with one of said recesses, said fastener passes through said first through hole and is connected to one of said insert portions.

6. The refrigerator according to claim 5, wherein said first fixing mechanism contains a first reinforcing member attached to a side of said inner casing, said side faces said thermal insulation material and said fastener fixing one of said insert portions to said first reinforcing member.

7. The refrigerator according to claim 6, wherein said inner casing has a rear wall;

wherein said first reinforcing member has a first reinforcing portion attached to said rear wall; and further comprising a second reinforcing portion coupled to said first reinforcing portion and bent backward.

8. The refrigerator according to claim 7, wherein:

said second reinforcing portion extends along said inner casing and is distanced from said inner casing; and said thermal insulation material is disposed between said inner casing and said second reinforcing portion.

9. The refrigerator according to claim 6, wherein said first reinforcing member has at least one second through hole formed therein, and said second through hole is configured to allow said thermal insulation material to pass through.

10. The refrigerator according to claim 1, wherein said beam contains a housing and a beam thermal insulation material disposed in said housing, said first fixing mechanism contains a second reinforcing member disposed in one of said insert portions, and said second reinforcing member is bonded to said beam thermal insulation material.

11. The refrigerator according to claim 10, wherein said second reinforcing member is disposed along a wall of said housing.

12. A refrigerator, comprising:

a cabinet having an inner casing, an outer casing, and a thermal insulation space disposed between said inner casing and said outer casing and filled with a thermal insulation material, to form a pair of thermal insulation walls disposed opposite to each other;

said thermal insulation walls having recesses formed in said inner casing and opened forward;

a beam bridging said pair of thermal insulation walls, said beam having insert portions disposed on two ends and respectively inserted into corresponding ones of said recesses;

a first fixing mechanism being at least partially disposed in one of said recesses and fixing one of said insert portions to said inner casing of one of said thermal insulation walls, said first fixing mechanism having a fastener;

said inner casing having a first through hole formed therein and in communication with one of said recesses, said fastener passing through said first through hole from a side of said inner casing, said side facing said thermal insulation space, and being connected to one of said insert portions; and a second fixing mechanism disposed outside said recesses and fixing said beam to said outer casing.

* * * * *